US010157694B2

(12) United States Patent
Ito et al.

(10) Patent No.: US 10,157,694 B2
(45) Date of Patent: Dec. 18, 2018

(54) COPPER ALLOY FOR ELECTRONIC/ELECTRIC DEVICE, COPPER ALLOY PLASTIC WORKING MATERIAL FOR ELECTRONIC/ELECTRIC DEVICE, AND COMPONENT AND TERMINAL FOR ELECTRONIC/ELECTRIC DEVICE

(71) Applicant: MITSUBISHI MATERIALS CORPORATION, Tokyo (JP)

(72) Inventors: Yuki Ito, Okegawa (JP); Kazunari Maki, Saitama (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 381 days.

(21) Appl. No.: 15/039,290

(22) PCT Filed: Oct. 22, 2014

(86) PCT No.: PCT/JP2014/078031

§ 371 (c)(1),
(2) Date: May 25, 2016

(87) PCT Pub. No.: WO2015/087624

PCT Pub. Date: Jun. 18, 2015

(65) Prior Publication Data

US 2017/0178761 A1 Jun. 22, 2017

(30) Foreign Application Priority Data

Dec. 11, 2013 (JP) ..... 2013-256310

(51) Int. Cl.

| | |
|---|---|
| ***C22C 9/00*** | (2006.01) |
| ***H01B 1/02*** | (2006.01) |
| ***C25D 7/00*** | (2006.01) |
| ***C22F 1/08*** | (2006.01) |
| ***B22D 21/00*** | (2006.01) |
| ***C22C 1/02*** | (2006.01) |
| ***C25D 3/30*** | (2006.01) |
| ***C22F 1/00*** | (2006.01) |
| *C25D 5/50* | (2006.01) |

(52) U.S. Cl.
CPC ..... *H01B 1/026* (2013.01); *B22D 21/005* (2013.01); *C22C 1/02* (2013.01); *C22C 9/00* (2013.01); *C22F 1/002* (2013.01); *C22F 1/08* (2013.01); *C25D 3/30* (2013.01); *C25D 7/00* (2013.01); *C25D 5/505* (2013.01)

(58) Field of Classification Search
CPC ..... C22F 1/08; C22C 9/00
See application file for complete search history.

(56) References Cited

U.S. PATENT DOCUMENTS

| | | | |
|---|---|---|---|
| 2008/0298998 | A1 | 12/2008 | Kaneko et al. |
| 2010/0132851 | A1 | 6/2010 | Gao et al. |
| 2013/0048162 | A1 | 2/2013 | Ito et al. |

FOREIGN PATENT DOCUMENTS

| | | | |
|---|---|---|---|
| CN | 102177273 | A | 9/2011 |
| CN | 102892908 | A | 1/2013 |
| JP | 07-018354 | A | 1/1995 |
| JP | 2009-007666 | A | 1/2009 |
| JP | 2010-126777 | A | 6/2010 |
| JP | 2011-241412 | A | 12/2011 |
| JP | 5045783 | B | 10/2012 |
| JP | 2013-095943 | A | 5/2013 |
| JP | 2013-100570 | A | 5/2013 |
| JP | 2013-104101 | A | 5/2013 |
| JP | 2013-204079 | A | 10/2013 |
| TW | 201339328 | A | 10/2013 |
| WO | WO-2003/076672 | A | 9/2003 |
| WO | WO-2012/169405 | A | 12/2012 |
| WO | WO-2013/062091 | A | 5/2013 |
| WO | WO-2013/069687 | A | 5/2013 |
| WO | WO-2013/073412 | A | 5/2013 |

OTHER PUBLICATIONS

Nomura, "Technical Trends in High Performance Copper Alloy Strip for Connector and Kobe Steel's Development Strategy", *Kobe Steel Works Engineering Reports*, Apr. 2004, pp. 2-8, vol. 54 No. 1.
Hori, et al., "Intergranular (Grain boundary) precipitation in a Cu—Mg alloy", *Journal of the Japan Copper and Brass Research Association*, 1980, pp. 115-124, vol. 19.
International Search Report dated Jan. 27, 2015 for the corresponding PCT Application No. PCT/JP2014/078031.
Office Action dated Oct. 27, 2015 for the corresponding Japanese Patent No. 2013-256310.
Office Action dated Nov. 9, 2015 for the corresponding Taiwanese Patent No. 103138036.
J.R. Davis, edited, "ASM Speciality Handbook-Copper and its alloys", Aug. 2001, pp. 15, *ASM International*, Materials Park, U.S.A.
E.G. West, "Copper and its alloys", 1982, pp. 129, *Ellis Horwood Limited*, Chichester, England.
Extended European Search Report dated Jul. 17, 2017 for the corresponding European Patent Application No. 14869335.1.
Office Action dated Apr. 14, 2017 for the corresponding Chinese Patent Application No. 201480065514.3.

*Primary Examiner* — Jessee R Roe
(74) *Attorney, Agent, or Firm* — Leason Ellis LLP

(57) ABSTRACT

This copper alloy for an electronic/electric device includes Mg at an amount of 3.3 atom % to 6.9 atom % with a remainder substantially being Cu and inevitable impurities, wherein a strength ratio $TS_{TD}/TS_{LD}$ is more than 1.02, and the strength ratio $TS_{TD}/TS_{LD}$ is calculated from a strength $TS_{TD}$ measured by a tensile test carried out in a direction perpendicular to a rolling direction and a strength $TS_{LD}$ measured by a tensile test carried out in a direction parallel to the rolling direction.

10 Claims, 2 Drawing Sheets

COPPER ALLOY FOR ELECTRONIC/ELECTRIC DEVICE, COPPER ALLOY PLASTIC WORKING MATERIAL FOR ELECTRONIC/ELECTRIC DEVICE, AND COMPONENT AND TERMINAL FOR ELECTRONIC/ELECTRIC DEVICE

CROSS-REFERENCE TO RELATED PATENT APPLICATIONS

This application is a U.S. National Phase Application under 35 U.S.C. § 371 of International Patent Application No. PCT/JP2014/078031, filed Oct. 22, 2014, and claims the benefit of Japanese Patent Application No. 2013-256310, filed Dec. 11, 2013, all of which are incorporated by reference in their entireties herein. The International Application was published in Japanese on Jun. 18, 2015 as International Publication No. WO/2015/087624 under PCT Article 21(2).

FIELD OF THE INVENTION

The present invention relates to a copper alloy for an electronic/electric device which is used for a component for an electronic/electric device such as a terminal including a connector in a semiconductor device or the like, a movable conductive piece for an electromagnetic relay, a lead frame, or the like, a plastically-worked copper alloy material (a copper alloy plastic working material) for an electronic/electric device consisting of the copper alloy for an electronic/electric device, and a component and a terminal for an electronic/electric device.

BACKGROUND OF THE INVENTION

In the related art, due to a reduction in the size of an electronic device or electric device, reductions in the size and the thickness of a component for an electronic/electric device such as a terminal including a connector or the like, a relay, a lead frame, or the like used in the electronic device, the electric device, or the like have been achieved. Therefore, as a material of the component for an electronic/electric device, a copper alloy having excellent spring properties, strength, and bending formability has been required. Particularly, as disclosed in Non-Patent Document 1, it is desirable for the copper alloy used in the component for an electronic/electric device such as a terminal including a connector or the like, a relay, a lead frame, or the like to have high proof stress.

As a copper alloy that is used for a component for an electronic/electric device such as a terminal including a connector or the like, a relay, a lead frame, or the like, the Cu—Mg alloy described in Non-Patent Document 2, the Cu—Mg—Zn—B alloy described in Patent Document 1, and the like have been developed.

With regard to the Cu—Mg based alloy, as is known from a Cu—Mg system phase diagram shown in FIG. 1, in the case where the amount of Mg is 3.3 at % or more, intermetallic compounds containing Cu and Mg can be precipitated by performing a solutionizing treatment and a precipitation treatment. That is, with regard to the Cu—Mg based alloy, relatively high electrical conductivity and strength can be achieved by precipitation hardening.

However, in the Cu—Mg-based alloy described in Non-Patent Document 2 and Patent Document 1, a large amount of coarse intermetallic compounds containing Cu and Mg as main components are dispersed in the matrix phase. Therefore, during bending working, these intermetallic compounds serve as starting points, and cracking and the like are likely to occur therefrom. As a result, there has been a problem in that the copper alloy cannot be formed into components for an electronic/electric device having complicated shapes.

Particularly, in components for an electronic/electric device which are used for commercial products such as mobile phones, personal computers, and the like, there is a demand for a reduction of size and weight, and a copper alloy for an electronic/electric device having both good strength and good bending formability is required. However, with regard to a precipitation hardening alloy such as the above-described Cu—Mg-based alloy, when strength and proof strength are improved by precipitation hardening, bending formability greatly degrades. Therefore, it has been impossible to form the copper alloy into a thin component for an electronic/electric device having a complicated shape.

Therefore, in Patent Document 2, a work hardening copper alloy of a Cu—Mg solid solution alloy supersaturated with Mg is proposed which is produced by rapidly cooling a Cu—Mg alloy after solutionizing.

This Cu—Mg alloy has excellent strength, electrical conductivity, and bendability and is particularly suitable as a material for the above-described components for an electronic/electric device.

Meanwhile, in recent years, the sizes and weights of electronic/electric devices have been further reduced. Here, with regard to a small-sized terminal that is used in an electronic/electric device having a reduced size and a reduced weight, from the viewpoint of the yield of a material, the material is bent so that the bending axis becomes a direction (Good Way: GW) perpendicular to a rolling direction, and the material is slightly deformed (bent) so that the bending axis becomes a direction (Bad Way: BW) parallel to the rolling direction. Thereby, the material is formed into the terminal, and the spring properties are ensured due to the material strength $TS_{TD}$ measured by a tensile test in the direction of BW. Therefore, an excellent bending formability in the direction of GW and a high strength in the direction of BW are obtained.

PRIOR ART DOCUMENTS

Patent Documents

Patent Document 1: Japanese Unexamined Patent Application, First Publication No. H7-018354

Patent Document 2: Japanese Patent No. 5045783

Non-Patent Documents

Non-Patent Document 1: Koya Nomura, "Technical Trends in High Performance Copper Alloy Strip for Connector and Kobe Steel's Development Strategy", Kobe Steel Works Engineering reports Vol. 54, No. 1 (2004), pp. 2 to 8

Non-Patent Document 2: Shigenori Hori, et al., "Intergranular (grain boundary) precipitation in a Cu—Mg alloy", Journal of the Japan Copper and Brass Research Association Vol. 19 (1980), pp. 115 to 124

Problems to be Solved by the Invention

The present invention has been made in consideration of the above-described circumstances, and an object of the present invention is to provide a copper alloy for an electronic/electric device which is excellent in a strength and a bending formability and, particularly, has an excellent bending formability in the direction of GW and a high strength in the direction of BW, a plastically-worked copper alloy material for an electronic/electric device, and a component and a terminal for an electronic/electric device.

SUMMARY OF THE INVENTION

Means for Solving the Problem

In order to solve the above-described problems, a copper alloy for an electronic/electric device according to an aspect of the present invention includes Mg at an amount of 3.3 atom % to 6.9 atom % with a remainder substantially being Cu and inevitable impurities, wherein a strength ratio $TS_{TD}/TS_{LD}$ is more than 1.02, and the strength ratio $TS_{TD}/TS_{LD}$ is calculated from a strength $TS_{TD}$ measured by a tensile test carried out in a direction perpendicular to a rolling direction and a strength $TS_{LD}$ measured by a tensile test carried out in a direction parallel to the rolling direction.

According to the copper alloy for an electronic/electric device having the above-described features, the strength ratio $TS_{TD}/TS_{LD}$ is more than 1.02, and the strength ratio $TS_{TD}/TS_{LD}$ is calculated from the strength $TS_{TD}$ measured by a tensile test carried out in a direction perpendicular to a rolling direction and the strength $TS_{LD}$ measured by a tensile test carried out in a direction parallel to the rolling direction. Therefore, a large number of {220} planes are present on the surface perpendicular to the direction normal to the rolling surface. As a result, the copper alloy for an electronic/electric device has an excellent bending formability when being bent so that the bending axis becomes a direction perpendicular to the rolling direction, and the tensile strength $TS_{TD}$ measured by a tensile test carried out in a direction perpendicular to the rolling direction becomes high. Therefore, the copper alloy for an electronic/electric device is excellent in formability so that the copper alloy can be formed into the above-described small-sized terminal.

Here, in the copper alloy for an electronic/electric device according to the aspect of the present invention, in a scanning electron microscopic observation, an average number of intermetallic compounds which have sizes of 0.1 μm or larger and include Cu and Mg as main components is preferably 1 piece/$\mu m^2$ or less.

In this case, as shown in the phase diagram of FIG. 1, Mg is included at an amount of 3.3 atom % to 6.9 atom % which is equal to or larger than the solid solubility limit, and, in a scanning electron microscopic observation, the average number of the intermetallic compounds which have sizes of 0.1 μm or larger and include Cu and Mg as main components is 1 piece/$\mu m^2$ or less. Therefore, precipitation of the intermetallic compounds containing Cu and Mg as main components is suppressed, and the copper alloy becomes a Cu—Mg solid solution alloy supersaturated with Mg in which Mg is solid-solubilized in the matrix phase.

Meanwhile, the average number of the intermetallic compounds which have sizes of 0.1 μm or larger and include Cu and Mg as main components is calculated by observing 10 visual fields of approximately 4.8 $\mu m^2$ at a 50,000-fold magnification using a field emission type scanning electron microscope.

The size of the intermetallic compound containing Cu and Mg as main components is defined as the average value of the long diameter (the length of the longest straight line in a grain which does not come into contact with a grain boundary on the way) and the short diameter (the length of the longest straight line in a direction orthogonal to the long diameter which does not come into contact with the grain boundary on the way) of the intermetallic compound.

In a copper alloy consisting of the above-described Cu—Mg solid solution alloy supersaturated with Mg, coarse intermetallic compounds containing Cu and Mg as main components, which serve as starting points for cracking, are not largely dispersed in the matrix phase of the copper alloy, and the bending formability thereof is improved. Therefore, it becomes possible to form the copper alloy into a component for an electronic/electric device having a complicated shape such as a terminal including a connector or the like, a relay, a lead frame, or the like.

Furthermore, since the copper alloy is supersaturated with Mg, it is possible to improve the strength thereof by work hardening.

In addition, in the copper alloy for an electronic/electric device according to the aspect of the present invention, when the amount of Mg is given as X atom %, the electrical conductivity σ (% IACS) is preferably in a range of the following expression.

$$\sigma \leq 1.7241/(-0.0347 \times X^2 + 0.6569 \times X) + 1.7) \times 100$$

In this case, as shown in the phase diagram of FIG. 1, Mg is included at an amount of 3.3 atom % to 6.9 atom % which is equal to or larger than the solid solubility limit, and the electrical conductivity is within the above-described range. Therefore, the copper alloy becomes a Cu—Mg solid solution alloy supersaturated with Mg in which Mg is solid-solubilized in the matrix phase.

Therefore, as described above, coarse intermetallic compounds containing Cu and Mg as main components, which serve as starting points for cracking, are not largely dispersed in the matrix phase of the copper alloy, and the bending formability thereof is improved.

Furthermore, since the copper alloy is supersaturated with Mg, it is possible to improve the strength thereof by work hardening.

Meanwhile, in the case of a binary alloy of Cu and Mg, the amount of Mg in terms of atom % may be calculated under conditions where inevitable impurity elements are ignored and the alloy is assumed to consist of Cu and Mg.

In addition, the copper alloy for an electronic/electric device according to the aspect of the present invention may further include one or more selected from Sn, Zn, Al, Ni, Si, Mn, Li, Ti, Fe, Co, Cr, Zr, and P at a total amount of 0.01 atom % to 3.00 atom %.

Since these elements have an effect of improving the characteristics of the Cu—Mg alloy such as strength and the like, the elements are preferably added in an appropriate manner in accordance with the required characteristics. Here, in the case where the total amount of the above-described elements is less than 0.01 atom %, the above-described effect of improving the strength cannot be sufficiently obtained. On the other hand, in the case where the total amount of the above-described elements is more than 3.00 atom %, the electrical conductivity greatly decreases. Therefore, in the aspect of the present invention, the total amount of the above-described elements is set to be in a range of 0.01 atom % to 3.00 atom %.

Furthermore, in the copper alloy for an electronic/electric device according to the aspect of the present invention, it is preferable that the strength $TS_{TD}$ measured by a tensile test carried out in a direction perpendicular to the rolling direction is 400 MPa or more, and a bending formability R/t is 1 or less, and the bending formability R/t is a ratio of a radius of a W bending jig which is represented by R to a thickness of the copper alloy which is represented by t when a direction perpendicular to the rolling direction is set as a bending axis.

In this case, since the strength $TS_{TA}$ measured by a tensile test carried out in a direction perpendicular to the rolling direction is 400 MPa or more, the strength is sufficiently high, and it is possible to ensure the spring properties in the direction of BW. In addition, since the bending formability R/t is 1 or less and the bending formability R/t is a ratio of a radius of a W bending jig which is represented by R to a thickness of the copper alloy which is represented by t when a direction perpendicular to the rolling direction is set as a bending axis, it is possible to sufficiently ensure the bending formability in the direction of GW. Therefore, the copper alloy for an electronic/electric device becomes particularly excellent in formability so that the copper alloy is formed into the above-described small-sized terminal.

A plastically-worked copper alloy material for an electronic/electric device according to an aspect of the present invention is formed by plastically working a copper material consisting of the above-described copper alloy for an electronic/electric device. In the present specification, a plastically-worked material refers to a copper alloy which has been subjected to plastic working in any manufacturing step.

Since a plastically-worked copper alloy material having the above-described features consists of a copper alloy for an electronic/electric device having excellent mechanical characteristics as described above, the plastically-worked copper alloy material is particularly suitable as a material for a component for an electronic/electric device such as a small-sized terminal or the like.

Here, the plastically-worked copper alloy material for an electronic/electric device according to the aspect of the present invention is preferably formed by a manufacturing method which includes: a heating step of heating the copper material to a temperature of 400° C. to 900° C.; a rapid cooling step of cooling the heated copper material to 200° C. or lower at a cooling rate of 60° C./min or higher; and a plastic working step of plastically working the copper material.

In this case, it is possible to conduct solutionizing of Mg by heating the copper material having the above-described composition to a temperature of 400° C. to 900° C. In addition, by cooling the heated copper material to 200° C. or lower at a cooling rate of 60° C./min or higher, it is possible to suppress precipitation of an intermetallic compounds in the cooling step, and the copper material can be a Cu—Mg solid solution alloy supersaturated with Mg. Therefore, coarse intermetallic compounds containing Cu and Mg as main components are not largely dispersed in the matrix phase of the copper alloy, and the bending formability thereof is improved.

In addition, in the plastically-worked copper alloy material for an electronic/electric device according to the aspect of the present invention, a surface may be subjected to Sn plating.

In this case, the contact resistance between contact points is stable when the plastically-worked copper alloy material is formed into a terminal, a connector, or the like, and it is also possible to improve the corrosion resistance.

A component for an electronic/electric device according to an aspect of the present invention consists of the above-described plastically-worked copper alloy material for an electronic/electric device. Examples of the component for an electronic/electric device according to the aspect of the present invention include a terminal including a connector and the like, a relay, a lead frame, and the like.

In addition, a terminal according to an aspect of the present invention consists of the above-described plastically-worked copper alloy material for an electronic/electric device.

Since the component and the terminal for an electronic/electric device having the above-described features are manufactured using the plastically-worked copper alloy material for an electronic/electric device having excellent mechanical characteristics, even in the case where the component and the terminal have a complicated shape, cracking or the like does not occur, and a sufficient strength is also ensured; and therefore, excellent reliability is obtained.

Effects of the Invention

According to the aspects of the present invention, it is possible to provide a copper alloy for an electronic/electric device which is excellent in strength and bending formability and, particularly, has an excellent bending formability in the direction of GW and a high strength in the direction of BW, a plastically-worked copper alloy material for an electronic/electric device, and a component and a terminal for an electronic/electric device.

DETAILED DESCRIPTION OF THE INVENTION

Figure 1:
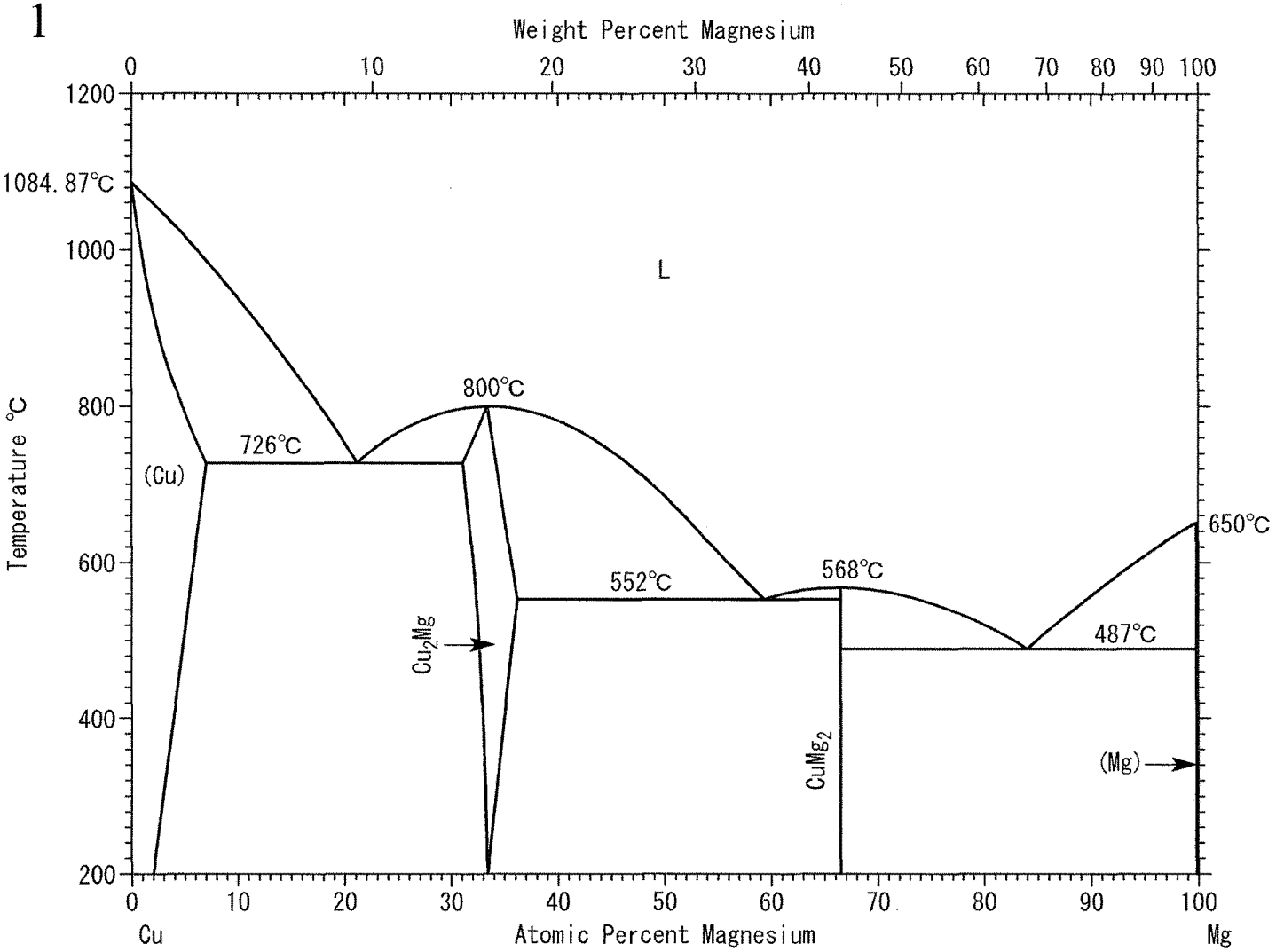
FIG. 1 is a phase diagram of a Cu—Mg system.

Hereinafter, embodiments of the present invention will be described with reference to the accompanying drawings.

The component composition of the copper alloy for an electronic/electric device according to the present embodiment includes Mg at an amount of 3.3 atom % to 6.9 atom % with a remainder substantially being Cu and inevitable impurities, that is, the copper alloy for an electronic/electric device is a binary alloy of Cu and Mg.

Here, when the amount of Mg is given as X atom %, the electrical conductivity σ (% IACS) is in a range of the following expression.

$$\sigma \leq 1.7241/(-0.0347 \times X^2 + 0.6569 \times X + 1.7) \times 100$$

In addition, in an observation using a scanning electron microscope, the average number of intermetallic compounds which have sizes of 0.1 μm or larger and include Cu and Mg as main components is 1 piece/$\mu m^2$ or less.

That is, in the copper alloy for an electronic/electric device according to the present embodiment, the intermetallic compounds which include Cu and Mg as main components are rarely precipitated, and the copper alloy becomes a Cu—Mg solid solution alloy supersaturated with Mg in which Mg is solid-solubilized in the matrix phase at an amount of equal to or larger than the solid solution limit.

In addition, in the copper alloy for an electronic/electric device according to the present embodiment, not only is the component composition adjusted as described above, but the mechanical characteristics such as strength, bending formability, and the like are also regulated as described below.

That is, in the copper alloy for an electronic/electric device according to the present embodiment, the strength ratio $TS_{TD}/TS_{LD}$ is more than 1.02 ($TS_{TD}/TS_{LD}>1.02$), and the strength ratio $TS_{TD}/TS_{LD}$ is calculated from the strength $TS_{TD}$ measured by a tensile test carried out in a direction perpendicular to a rolling direction and the strength $TS_{LD}$ measured by a tensile test carried out in a direction parallel to the rolling direction.

Here, the reasons for regulating the component composition, the electrical conductivity, the number of precipitates, and the mechanical characteristics as described above will be described.

(Mg: 3.3 Atom % to 6.9 Atom %)

Mg is an element having an effect of improving strength and increasing the recrystallization temperature while not greatly degrading electrical conductivity. In addition, excellent bending formability is obtained by solid-solubilizing Mg in the matrix phase.

Here, in the case where the amount of Mg is less than 3.3 atom %, the effects cannot be obtained. On the other hand, in the case where the amount of Mg is more than 6.9 atom %, intermetallic compounds containing Cu and Mg as main components remain when a heat treatment for solutionizing is carried out, and there is a concern that cracking may occur during the subsequent hot working and cold working. For these reasons, the amount of Mg is set to be in a range of 3.3 atom % to 6.9 atom %.

Meanwhile, in the case where the amount of Mg is small, the strength is not sufficiently improved. In addition, Mg is an active element. Therefore, in the case where excessive amount of Mg is added, there is a concern that Mg may react with oxygen and form Mg oxides and the Mg oxides may be included in the copper alloy during melting and casting. Therefore, the amount of Mg is more preferably set to be in a range of 3.7 atom % to 6.3 atom %.

Here, regarding the above-described composition values in atom %, in the present embodiment, since the copper alloy is a binary alloy of Cu and Mg, the composition values in atom % are calculated from amounts in mass % with an assumption that the copper alloy is composed of Cu and Mg while ignoring inevitable impurities.

Examples of the inevitable impurities include Ag, B, Ca, Sr, Ba, Sc, Y, rare-earth elements, Hf, V, Nb, Ta, Mo, W, Re, Ru, Os, Se, Te, Rh, Jr, Pd, Pt, Au, Cd, Ga, In, Ge, As, Sb, Tl, Pb, Bi, Be, N, Hg, H, C, O, S, Sn, Zn, Al, Ni, Si, Mn, Li, Ti, Fe, Co, Cr, Zr, P, and the like. The total amount of these inevitable impurities is desirably 0.3 mass % or less.

(Electrical Conductivity σ)

In a binary alloy of Cu and Mg, when the amount of Mg is given as X atom %, in the case where the electrical conductivity σ is in a range of the following expression, intermetallic compounds are rarely present.

$$\sigma \leq 1.7241/(-0.0347 \times X^2 + 0.6569 \times X + 1.7) \times 100$$

That is, in the case where the electrical conductivity σ is more than the range of the above-described expression, a large amount of intermetallic compounds containing Cu and Mg as main components are present, and the sizes thereof are relatively large. As a result, bending formability greatly deteriorates. Therefore, manufacturing conditions are adjusted so that the electrical conductivity σ falls within the range of the above-described expression.

Meanwhile, in order to reliably obtain the above-described effects, the electrical conductivity σ (% IACS) is preferably set to be in a range of the following expression.

$$\sigma \leq 1.7241/(-0.0292 \times X^2 + 0.6797 \times X + 1.7) \times 100$$

In this case, the amount of the intermetallic compounds containing Cu and Mg as main components becomes smaller; and thereby, bending formability is further improved.

(Precipitates)

In the copper alloy for an electronic/electric device according to the present embodiment, as a result of observing the copper alloy using a scanning electron microscope, it is found that the average number of intermetallic compounds which have sizes of 0.1 μm or larger and include Cu and Mg as main components is 1 piece/$\mu m^2$ or less. That is, the intermetallic compounds containing Cu and Mg as main components are rarely precipitated, and Mg is solid-solubilized in the matrix phase.

Here, in the case where solutionizing is incomplete, or in the case where intermetallic compounds containing Cu and Mg as main components are precipitated after the solutionizing, a large amount of large-sized intermetallic compounds are present. In this case, these intermetallic compounds serve as starting points for cracking, and bending formability greatly deteriorates.

As a result of investigating the structure of the copper alloy, it is found that, in the case where the average number of intermetallic compounds which have sizes of 0.1 μm or larger and include Cu and Mg as main components is 1 piece/$\mu m^2$ or less, that is, the intermetallic compounds containing Cu and Mg as main components are not present or the amount thereof is small, favorable bending formability is obtained.

Furthermore, in order to reliably obtain the above-described effects, it is more preferable that the average number of intermetallic compounds which have sizes of 0.05 μm or larger and include Cu and Mg as main components is set to be 1 piece/$\mu m^2$ or less in the alloy.

Meanwhile, the average number of the intermetallic compounds containing Cu and Mg as main components is obtained by observing 10 visual fields of approximately 4.8 $\mu m^2$ at a 50,000-fold magnification using a field emission type scanning electron microscope and calculating the average number of the observed intermetallic compounds.

In addition, the size of the intermetallic compound containing Cu and Mg as main components is defined as the average value of the long diameter (the length of the longest straight line in a grain which does not come into contact with a grain boundary on the way) and the short diameter (the length of the longest straight line in a direction orthogonal to the long diameter which does not come into contact with the grain boundary on the way) of the intermetallic compound.

Here, the intermetallic compound containing Cu and Mg as main components has a crystal structure expressed by a chemical formula of $MgCu_2$, a prototype of $MgCu_2$, a Pearson symbol of cF24, and a space group number of Fd-3m.

($TS_{TD}/TS_{LD}>1.02$)

In the case where the strength ratio $TS_{TD}/TS_{LD}$ is more than 1.02, a large number of {220} planes are present on the surface perpendicular to the direction normal to the rolling surface. When the number of the {220} planes is increased, the copper alloy has an excellent bending formability when being subjected to bending working under conditions where the bending axis becomes perpendicular to the rolling direction, and the strength $TS_{TD}$ measured by a tensile test carried out in a direction perpendicular to the rolling direction becomes high. Meanwhile, in the case where the {220} plane is greatly generated, a worked structure is formed, and the bending formability deteriorates.

Based on these findings, in the present embodiment, the strength ratio $TS_{TD}/TS_{LD}$ is more than 1.02, and the strength ratio $TS_{TD}/TS_{LD}$ is calculated from the strength $TS_{TD}$ measured by a tensile test carried out in a direction perpendicular to a rolling direction and the strength $TS_{LD}$ measured by a tensile test carried out in a direction parallel to the rolling direction. Meanwhile, the strength ratio $TS_{TD}/TS_{LD}$ is preferably 1.05 or more. In addition, the strength ratio $TS_{TD}/TS_{LD}$ is preferably 1.3 or less and more preferably 1.25 or less.

Here, in the copper alloy for an electronic/electric device according to the present embodiment, it is preferable that the strength $TS_{TD}$ measured by a tensile test carried out in a direction perpendicular to a rolling direction is 400 MPa or more, and the bending formability R/t is 1 or less. The bending formability R/t is a ratio of a radius of a W bending jig which is represented by R to the thickness of the copper alloy which is represented by t when a direction perpendicular to the rolling direction is set as a bending axis. When the strength $TS_{TD}$ and the ratio R/t are set to be in the ranges as described above, it becomes possible to ensure a sufficient strength in the TD direction and the bending formability in the direction of GW.

Figure 2:
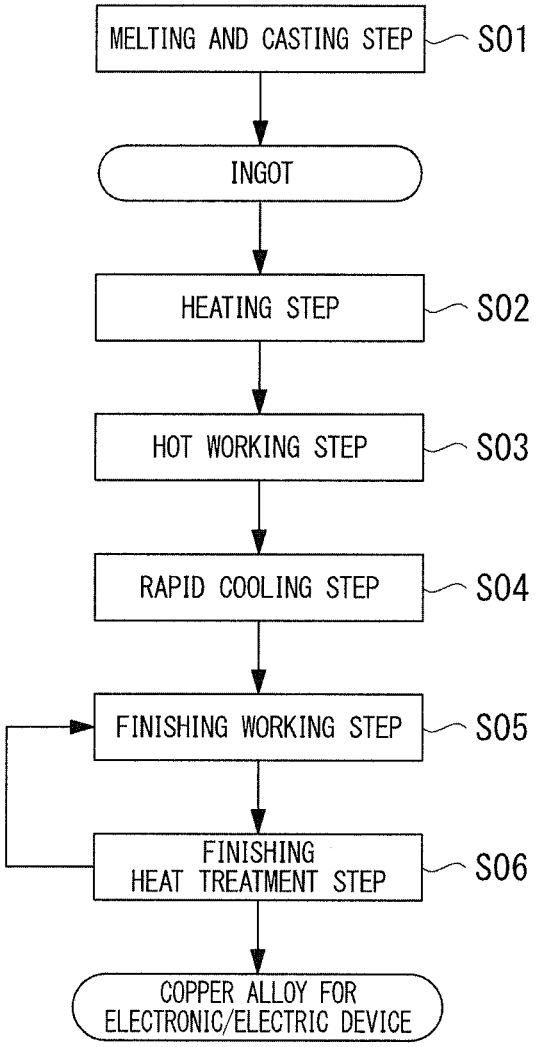
FIG. 2 is a flowchart of a method for manufacturing a copper alloy for an electronic/electric device according to the present embodiment.

Next, a method for manufacturing a copper alloy for an electronic/electric device according to the present embodiment having the above-described features and a method for manufacturing a plastically-worked copper alloy material for an electronic/electric device will be described with reference to the flowchart in FIG. 2.

(Melting and Casting Step S01)

First, a copper raw material is melted to obtain a molten copper, and the above-described elements are added to the molten copper so as to adjust components; and thereby, a molten copper alloy is produced. Here, a single element of Mg, a Cu—Mg master alloy, and the like can be used as a raw material of Mg. In addition, a raw material containing Mg may be melted together with the copper raw material. In addition, a recycled material and a scrapped material of the copper alloy of the present embodiment may be used.

Here, it is preferable that the molten copper consists of copper having purity of 99.99% by mass or more, that is, so-called 4N Cu. In addition, in the melting process, it is preferable to use a vacuum furnace, or an atmosphere furnace of which atmosphere is an inert gas atmosphere or a reducing atmosphere so as to suppress oxidization of Mg.

Then, the molten copper alloy of which the components are adjusted is casted into a mold so as to produce ingots (copper material). In the case where mass production is taken into account, it is preferable to apply a continuous casting method or a semi-continuous casting method.

(Heating Step S02)

Next, a heating treatment is performed for homogenization and solutionizing (solution treatment) of the obtained ingot. During the progress of solidification, Mg segregates and concentrates; and thereby, intermetallic compounds containing Cu and Mg as main components and the like are generated. In the interior of the ingot, these intermetallic compounds and the like are present. Therefore, in order to eliminate or reduce the segregation of Mg and in order to eliminate or reduce the intermetallic compounds and the like, the ingot is subjected to the heat treatment to heat the ingot to a temperature of 400 to 900° C. Thereby, Mg is homogeneously diffused, and Mg is solid-solubilized in the matrix phase in the ingot. In addition, it is preferable that the heating process S02 is performed in a non-oxidization atmosphere or a reducing atmosphere.

Here, in the case where the heating temperature is lower than 400° C., solutionizing is incomplete, and thus there is concern that a large amount of the intermetallic compounds containing Cu and Mg as main components may remain in the matrix phase. In contrast, in the case where the heating temperature is higher than 900° C., a portion of the copper material becomes a liquid phase, and there is concern that the structure or the surface state thereof may become non-uniform. Therefore, the heating temperature is set to be 400° C. to 900° C. The heating temperature is preferably 400° C. to 850° C., and more preferably 420° C. to 800° C.

(Hot Working Step S03)

In order to increase the efficiency of rough working (processing) and to homogenize the structure, hot working is carried out after the heating step S02. At this time, the working method is not particularly limited, and, in the case where the final form is a sheet (plate) or a strip, hot rolling may be employed. In the case where the final form is a wire or a bar (rod), extruding or groove rolling may be employed. In the case where the final form is a bulk shape, forging or pressing may be employed. In addition, the temperature of the hot working is preferably set to be 400° C. to 900° C., more preferably set to be 450° C. to 800° C., and optimally set to be 450° C. to 750° C. Here, in the hot working step S03, a recrystallization structure having an average grain size of 3 μm or larger is obtained. Thereby, it becomes possible to efficiently increase the strength ratio $TS_{TD}/TS_{LD}$ during finishing working described below. Meanwhile, this hot working step S03 may not be carried out.

(Rapid Cooling Step S04)

After the hot working step S03, a rapid cooling step S04 is carried out in which the copper material is cooled to a temperature of 200° C. or lower at a cooling rate of 60° C./min or higher. Due to this rapid cooling step S04, Mg solid-solubilized in the matrix phase is suppressed from precipitating as the intermetallic compounds containing Cu and Mg as main components. As a result, it is possible to obtain a copper alloy in which an average number of intermetallic compounds having sizes of 0.1 μm or more and containing Cu and Mg as main components is in a range of 1 piece/$m^2$ or less in the observation by a scanning electron microscope. That is, the copper material can be a Cu—Mg solid solution alloy supersaturated with Mg.

(Finishing Working Step S05)

The copper material which has been subjected to the rapid cooling step S04 is subjected to finishing working so as to have a predetermined shape. When the working ratio after the formation of the recrystallization structure is increased, it becomes possible to increase the strength ratio $TS_{TD}/TS_{LD}$. Here, the working method is not particularly limited. For example, rolling may be employed in the case where the final form is a sheet (plate) or a strip. Drawing, extruding, groove rolling, or the like may be employed in the case where the final form is a wire or a bar (rod). Forging or pressing may be employed in the case where the final form is a bulk shape. In addition, in the finishing working step S05, the temperature condition is not particularly limited, but the temperature is preferably set to be −200° C. to 200° C. which is in a cold or warm working state. In addition, the working ratio is appropriately selected so as to obtain a shape close to the final form, and, in order to increase the above-described strength ratio $TS_{TD}/TS_{LD}$, the working ratio is preferably set to be 30% or more and more preferably set to be 40% or more.

(Finishing Heat Treatment Step S06)

Next, the copper material that has been subjected to the finishing working step S05 is subjected to a finishing heat treatment in order to remove residual strains. The heat treatment temperature is preferably set to be in a range of 200° C. to 800° C. Meanwhile, in the finishing heat treatment step S05, it is necessary to set the heat treatment conditions (temperature, time, and cooling rate) so as to prevent solid-solubilized Mg from being precipitated. For example, the heat treatment conditions are preferably set to be approximately 1 minute to 24 hours at 200° C., and approximately 1 second to 10 seconds at 400° C. This heat treatment is preferably carried out in a non-oxidizing atmosphere or a reducing atmosphere.

In addition, regarding a cooling method, the heated copper material is preferably cooled to 100° C. or lower at a cooling rate of 60° C./min or higher by water quenching or the like. By rapidly cooling the copper material as described above, Mg solid-solubilized in the matrix phase is suppressed from precipitating as the intermetallic compounds containing Cu and Mg as main components, and the copper material can be a Cu—Mg solid solution alloy supersaturated with Mg.

Furthermore, the finishing working step S05 and the finishing heat treatment S06 may be repeatedly carried out.

The copper alloy for an electronic/electric device and the plastically-worked copper alloy material for an electronic/electric device according to the present embodiment are produced in the above-described manner. Meanwhile, in the plastically-worked copper alloy material for an electronic/electric device, the surface may be plated with Sn to have a plated layer having a film thickness of approximately 0.1 μm to 10 μm.

The method for Sn plating in this case is not particularly limited, and electrolytic plating may be applied according to an ordinary method, or a reflow treatment may be carried out after electrolytic plating depending on cases.

In addition, a component and a terminal for an electronic/electric device according to the present embodiment are manufactured by subjecting the above-described plastically-worked copper alloy material for an electronic/electric device to punching working, bending working, or the like.

According to the copper alloy for an electronic/electric device according to the present embodiment having the above-described features, the strength ratio $TS_{TD}/TS_{LD}$ is more than 1.02, and the strength ratio $TS_{TD}/TS_{LD}$ is calculated from the strength $TS_{TD}$ measured by a tensile test carried out in a direction perpendicular to a rolling direction and the strength $TS_{LD}$ measured by a tensile test carried out in a direction parallel to the rolling direction. Therefore, a large number of {220} planes are present on the surface perpendicular to the direction normal to the rolling surface. Therefore, the copper alloy has an excellent bending formability when being subjected to bending working under conditions where the bending axis becomes perpendicular to the rolling direction, and the strength $TS_{TD}$ measured by a tensile test carried out in a direction perpendicular to the rolling direction becomes high. Therefore, the copper alloy is excellent in formability so that the copper alloy can be formed into the above-described small-sized terminal.

In addition, in the copper alloy for an electronic/electric device of the present embodiment, in the observation using a scanning electron microscope, the average number of intermetallic compounds which have sizes of 0.1 μm or larger and include Cu and Mg as main components is 1 piece/$m^2$ or less. When the amount of Mg is given as X atom %, the electrical conductivity σ (% IACS) is in a range of the following expression. The copper alloy becomes a Cu—Mg solid solution alloy supersaturated with Mg in which Mg is solid-solubilized in the matrix phase.

$$\sigma \leq 1.7241/(-0.0347 \times X^2 + 0.6569 \times X + 1.7) \times 100$$

Therefore, coarse intermetallic compounds containing Cu and Mg as main components, which serve as starting points for cracking, are not largely dispersed in the matrix phase of the copper alloy, and the bending formability thereof is improved. Therefore, it becomes possible to form the copper alloy into a component for an electronic/electric device having a complicated shape such as a terminal including a connector or the like, a relay, a lead frame, or the like. Furthermore, since the copper alloy is supersaturated with Mg, it is possible to improve the strength thereof by work hardening.

Here, in the present embodiment, the copper alloy for an electronic/electric device is manufactured by the manufacturing method which includes: the heating step S02 of heating the copper material having the above-described composition to a temperature of 400° C. to 900° C.; the rapid cooling step S04 of cooling the heated copper material to 200° C. or lower at a cooling rate of 60° C./min or higher; the hot working step S02 of plastically working the copper material; and the finishing working step S05. Therefore, the copper alloy for an electronic/electric device can be a Cu—Mg solid solution alloy supersaturated with Mg in which Mg is solid-solubilized in the matrix phase as described above.

In addition, since the component and the terminal for an electronic/electric device according to the present embodiment are manufactured using the above-described plastically-worked copper alloy material for an electronic/electric device, the proof stress is high, and bending formability is excellent. Therefore, cracking or the like does not occur when the copper alloy is formed into complicated shapes, and reliability is improved.

The copper alloy for an electronic/electric device, the plastically-worked copper alloy material for an electronic/electric device, the component and the terminal for an electronic/electric device, which are embodiments of the present invention, have been described, but the present invention is not limited thereto and can be appropriately modified within the scope of the features of the invention.

For example, in the above-described embodiments, examples of the method for manufacturing a copper alloy for an electronic/electric device and the method for manufacturing a plastically-worked copper alloy material for an electronic/electric device have been described, but the manufacturing methods are not limited to the present embodiments, and the copper alloy for an electronic/electric device and the plastically-worked copper alloy material for an electronic/electric device may be manufactured by appropriately selecting existing manufacturing methods.

In addition, in the present embodiment, examples of the binary alloy of Cu—Mg have been described, but the copper alloy is not limited thereto and may include one or more selected from Sn, Zn, Al, Ni, Si, Mn, Li, Ti, Fe, Co, Cr, Zr, and P at a total amount of 0.01 atom % to 3.00 atom %.

Since the elements of Sn, Zn, Al, Ni, Si, Mn, Li, Ti, Fe, Co, Cr, Zr, and P are elements improving the characteristics of a Cu—Mg alloy such as strength and the like, the elements are preferably added to the copper alloy in an appropriate manner in accordance with the required characteristics. Here, since the total amount of those elements is set to be 0.01 atom % or more, it is possible to reliably improve the strength of a Cu—Mg alloy. Meanwhile, since the total amount of those elements is set to be 3.00 atom % or less, it is possible to ensure electrical conductivity.

Meanwhile, in the case where the above-described elements are included, the regulation of the electrical conductivity described in the embodiments is not applied, but it is possible to confirm that the copper alloy is a Cu—Mg supersaturated solid solution alloy from the distribution state of precipitates. In addition, regarding the amounts in atom % of the elements, the concentrations in atom % are calculated from the measured amounts in mass % with an assumption that the alloy is composed of Cu, Mg, and these additive elements.

EXAMPLES

Hereinafter, results of confirmation tests carried out in order to confirm the effects of the present invention will be described.

A copper raw material consisting of oxygen-free copper (ASTM B152 C10100) having a purity of 99.99 mass % or more was prepared. The copper raw material was charged in a high purity graphite crucible, and was melted by a high frequency heater in a furnace of which the atmosphere was set to an Ar gas atmosphere. Various additive elements were added to the obtained molten copper so as to prepare component compositions shown in Table 1, each of the resultants was poured into a carbon casting mold; and thereby, an ingot was produced. The dimensions of the ingot were about 120 mm in thickness×about 220 mm in width× about 300 mm in length.

In addition, regarding the composition in at % (atom %) shown in Table 1, the concentrations in atom % were calculated from the measured amounts in mass % with an assumption that the alloy was composed of Cu, Mg, and the other additive elements.

With regard to the obtained ingot, 10 mm or more of a portion at or in the vicinity of the cast surface (the surface of the ingot remaining in a state of being casted) was subjected to surface grinding, and then a block having dimensions of 100 mm×200 mm×100 mm was cut out from the ingot.

This block was held in an Ar gas atmosphere for 48 hours under a temperature condition shown in Table 1. Next, the block that had been heated and held was subjected to hot rolling under the conditions shown in Table 1, and then water quenching was performed.

Next, finishing rolling was carried out at a rolling reduction ratio shown in Table 1; and thereby, a thin sheet having a thickness of 0.25 mm and a width of approximately 200 mm was produced.

After the finishing rolling, a finishing heat treatment was carried out in an Ar atmosphere under the conditions shown in Table 1, and then water quenching was carried out; and thereby, a thin sheet for characteristic evaluation.

(Average Grain Size of Hot-Rolled Material)

The metal microstructure of the hot-rolled material that had been subjected to hot rolling as described above was observed. A surface perpendicular to the width direction of the rolling, that is, a TD (Transverse direction) surface was set to be an observation surface, and the grain boundaries and the distribution of differences of crystal orientation were measured as described below by an EBSD measurement apparatus and OIM analysis software.

The surface was mechanically polished using waterproof abrasive paper and diamond abrasive grains. Then, finishing polishing was performed using a colloidal silica solution. Analysis of orientation difference of each crystal grain was performed on a measurement surface area of 1000 $\mu m^2$ or more with an accelerating voltage of an electron beam of 20 kV at every measurement intervals of 0.1 μm, by an EBSD measurement apparatus (Quanta FEG 450 manufactured by FEI Company, OIM Data Collection manufactured by EDAX/TSL (currently AMETEK, Inc.)), and analysis software (OIM Data Analysis ver. 5.3 manufactured by EDAX/TSL (currently AMETEK, Inc.)). The CI value of each measurement point was calculated by the analysis software OIM, and data of which the CI value was 0.1 or less were removed in analysis of the grain size. Regarding the grain size, as a result of two-dimensional cross section observation, a boundary between measurement points in which an orientation difference between neighboring two crystals was 15° or more was assigned as a grain boundary; and thereby, a grain boundary map was created. Based on a cutting method of JIS H 0501, five lines having predetermined lengths were drawn in each of vertical and horizontal directions on the grain boundary map, a number of crystal grains which were completely cut were counted, and the average value of the cut length was set as the average grain size.

(Evaluation of Formability)

As an evaluation of formability, the presence or absence of edge cracking during the above-described finishing rolling was observed. A thin sheet in which edge crackings were not or rarely observed visually was evaluated as @ (excellent). A thin sheet in which small edge crackings having lengths of shorter than 1 mm were generated was evaluated as ○ (good). A thin sheet in which small edge crackings having lengths of 1 mm to shorter than 3 mm were generated was evaluated as Δ (fair). A thin sheet in which large edge crackings having lengths of 3 mm or longer were generated was evaluated as x (bad). A thin sheet which was ruptured due to edge crackings in the process of rolling was evaluated as xx (very bad).

Meanwhile, the length of the edge cracking refers to the length of the edge cracking propagating from the edge to the center of a rolled material in the width direction.

(Observation of Precipitates)

A rolled surface of each specimen was subjected to mirror polishing and ion etching. In order to confirm a precipitation state of the intermetallic compounds containing Cu and Mg as main components, observation was performed in a visual field at a 10,000-fold magnification (approximately 120 $\mu m^2$/visual field) by using FE-SEM (field emission type scanning electron microscope).

Next, in order to investigate the density (pieces/$m^2$) of the intermetallic compounds containing Cu and Mg as main components, a visual field at a 10,000-fold magnification (approximately 120 $\mu m^2$/visual field) in which the precipitation state of the intermetallic compounds was not special was selected, and at that region, continuous 10 visual fields (approximately 4.8 $\mu m^2$/visual field) at a 50,000-fold magnification were photographed. As the size of the intermetallic compound, the average value of the long diameter (the length of the longest straight line in a grain which does not come into contact with a grain boundary on the way) and the short diameter (the length of the longest straight line in a direction orthogonal to the long diameter which does not come into contact with the grain boundary on the way) of the intermetallic compound was used. Then, the density (pieces/$\mu m^2$) of the intermetallic compounds which had sizes of 0.1 μm or larger and contained Cu and Mg as main components was obtained.

(Mechanical Characteristics)

A No. 13B test specimen defined in JIS Z 2241 was sampled from each of the thin sheet for characteristic evaluation. According to JIS Z 2241, the tensile strength $TS_{TD}$ was measured by a tensile test carried out in a direction perpendicular to a rolling direction and the tensile strength $TS_{LD}$ was measured by a tensile test carried out in a direction parallel to the rolling direction. $TS_{TD}/TS_{LD}$ was calculated from the respective obtained values.

(Bending Formability)

Bending working was carried out on the basis of the four test method of Japan Copper and Brass Association Technical Standard JCBA-T307:2007. A plurality of test specimens having a width of 10 mm and a length of 30 mm were sampled from each of the thin sheets for characteristic evaluation so that the bending axis became perpendicular to the rolling direction, and a W bending test was carried out using a W-shaped jig having a bending angle of 90 degrees and a bending radius of 0.25 mm (R/t=1).

The outer circumferential portion of the bent portion was visually checked, and a test specimen in which cracking was observed was determined to be "x" (bad). A test specimen in which rupture or fine cracks were not confirmed was determined to be "○" (good). That is, in a test specimen evaluated to be "○", R/t=0.25/0.25=1.0 or less.

(Electrical Conductivity)

A test specimen having a width of 10 mm and a length of 150 mm was sampled from each of the thin sheets for characteristic evaluation, and the electric resistance was measured by the four-terminal method. In addition, the dimensions of the test specimen were measured using a micrometer, and the volume of the test specimen was calculated. Then, the electrical conductivity was calculated from the measured electric resistance and the volume. Meanwhile, the test specimen was sampled so that the longitudinal direction of the test specimen became perpendicular to the rolling direction of the thin sheet for characteristic evaluation.

The component compositions, the manufacturing conditions, and the evaluation results are shown in Tables 1 and 2.

TABLE 1

| | | Component composition (atom %) | | | | Manufacturing conditions | | | | |
|---|---|---|---|---|---|---|---|---|---|---|
| | | | | | | | Hot rolling | Finishing rolling | | |
| | | Mg | Other elements | | Cu | Heating step temperature | reduction ratio | reduction ratio | Finishing heat treatment Temperature | Finishing heat treatment Duration |
| Invention Examples | 1 | 3.3 | — | — | Remainder | 770° C. | 95% | 85% | 250° C. | 10 sec |
| | 2 | 3.7 | — | — | Remainder | 750° C. | 95% | 50% | 340° C. | 15 sec |
| | 3 | 4.0 | — | — | Remainder | 700° C. | 96% | 70% | 320° C. | 10 sec |
| | 4 | 4.0 | — | — | Remainder | 650° C. | 94% | 99% | 300° C. | 60 sec |
| | 5 | 4.2 | — | — | Remainder | 650° C. | 93% | 70% | 310° C. | 60 sec |
| | 6 | 5.1 | — | — | Remainder | 650° C. | 95% | 70% | 280° C. | 120 sec |
| | 7 | 5.9 | — | — | Remainder | 650° C. | 95% | 60% | 300° C. | 55 sec |
| | 8 | 6.8 | — | — | Remainder | 650° C. | 93% | 65% | 350° C. | 30 sec |
| | 9 | 3.8 | Sn: 0.1 | Al: 0.1 | Remainder | 780° C. | 94% | 70% | 340° C. | 20 sec |
| | 10 | 3.9 | Zn: 0.2 | Mn: 0.2 | Remainder | 700° C. | 95% | 80% | 330° C. | 15 sec |
| | 11 | 4.0 | Ni: 0.2 | Zr: 0.02 | Remainder | 700° C. | 90% | 60% | 360° C. | 15 sec |
| | 12 | 4.2 | Si: 0.1 | P: 0.03 | Remainder | 650° C. | 90% | 70% | 320° C. | 10 sec |
| | 13 | 4.3 | Li: 0.1 | Cr: 0.03 | Remainder | 650° C. | 95% | 70% | 310° C. | 30 sec |
| | 14 | 4.3 | Ti: 0.05 | — | Remainder | 650° C. | 93% | 70% | 320° C. | 30 sec |
| | 15 | 4.3 | Fe: 0.02 | Co: 0.02 | Remainder | 650° C. | 94% | 60% | 320° C. | 40 sec |
| Comparative Examples | 1 | 1.8 | — | — | Remainder | 750° C. | 95% | 30% | 360° C. | 20 sec |
| | 2 | 8.7 | — | — | Remainder | 710° C. | 80% | — | — | — |
| | 3 | 3.5 | — | — | Remainder | 600° C. | 90% | 25% | 350° C. | 30 sec |

TABLE 2

| | | Average grain size after hot rolling | Edge cracking | Precipitates (pieces/μm²) Sizes of 0.05 μm or larger | Sizes of 0.1 μm or larger | $TS_{LD}$ MPa | $TS_{TD}$ MPa | $TS_{TD}/TS_{LD}$ | Bending properties GW | Electrical conductivity % IACS |
|---|---|---|---|---|---|---|---|---|---|---|
| Invention Examples | 1 | 15 μm | ○ | 0 | 0 | 655 | 745 | 1.14 | ○ | 45% |
| | 2 | 13 μm | ○ | 0 | 0 | 613 | 641 | 1.05 | ○ | 42% |
| | 3 | 9 μm | ○ | 0 | 0 | 665 | 730 | 1.10 | ○ | 42% |
| | 4 | 8 μm | ○ | 0 | 0 | 854 | 1003 | 1.17 | ○ | 41% |
| | 5 | 7.5 μm | ○ | 0 | 0 | 669 | 734 | 1.10 | ○ | 39% |
| | 6 | 7.1 μm | ○ | 0.8 | 0.5 | 750 | 823 | 1.10 | ○ | 35% |
| | 7 | 7.5 μm | ○ | 0.7 | 0.6 | 775 | 831 | 1.07 | ○ | 32% |
| | 8 | 6.4 μm | ○ | 0.8 | 0.5 | 808 | 877 | 1.08 | ○ | 28% |
| | 9 | 17 μm | ○ | 0 | 0 | 709 | 778 | 1.10 | ○ | 38% |
| | 10 | 15 μm | ○ | 0 | 0 | 761 | 855 | 1.12 | ○ | 35% |
| | 11 | 16 μm | ○ | 0 | 0 | 661 | 708 | 1.07 | ○ | 36% |
| | 12 | 18 μm | ○ | 0 | 0 | 689 | 756 | 1.10 | ○ | 34% |
| | 13 | 10 μm | ○ | 0 | 0 | 698 | 766 | 1.10 | ○ | 37% |
| | 14 | 10 μm | ○ | 0.2 | 0.1 | 692 | 760 | 1.10 | ○ | 34% |
| | 15 | 6 μm | ○ | 0 | 0 | 697 | 747 | 1.07 | ○ | 36% |
| Comparative Examples | 1 | 20 μm | ○ | 0 | 0 | 381 | 385 | 1.01 | ○ | 62% |
| | 2 | — | xx | — | — | — | — | — | — | — |
| | 3 | 7 μm | ○ | 0 | 0 | 392 | 393 | 1.00 | ○ | 44% |

In Comparative Example 1 in which the amount of Mg was smaller than the range of the present embodiment, the strength $TS_{LD}$ measured by a tensile test carried out in a direction parallel to the rolling direction was 381 MPa, and the strength $TS_{TD}$ measured by a tensile test carried out in a direction perpendicular to the rolling direction was 385 MPa which was low. In addition, the strength ratio $TS_{TD}/TS_{LD}$ was 1.02 or less.

In Comparative Example 2 in which the amount of Mg was larger than the range of the present embodiment, large edge crackings were generated during the finishing rolling, and it was not possible to carry out the subsequent characteristic evaluation.

In Comparative Example 3, the amount of Mg was in the range of the present embodiment, but the strength ratio $TS_{TD}/TS_{LD}$ was 1.00. The strength $TS_{LD}$ measured by a tensile test carried out in a direction parallel to the rolling direction was 392 MPa, the strength $TS_{TD}$ measured by a tensile test carried out in a direction perpendicular to the rolling direction was 393 MPa which was low, and the strength was insufficient.

In contrast, in Invention Examples 1 to 8 in which the amounts of Mg were in the range of the present embodiment, and the strength ratios $TS_{TD}/TS_{LD}$ were more than 1.02, both the strength $TS_{LD}$ measured by a tensile test carried out in a direction parallel to the rolling direction and the strength $TS_{TD}$ measured by a tensile test carried out in a direction perpendicular to the rolling direction were high, and the bending formability was favorable. In addition, edge crackings were not generated.

In addition, in Invention Examples 9 to 15 in which the additive elements other than Mg were added at amounts within the range of the present embodiment, and the strength ratios $TS_{TD}/TS_{LD}$ were more than 1.02, both the strength $TS_{LD}$ measured by a tensile test carried out in a direction parallel to the rolling direction and the strength $TS_{TD}$ measured by a tensile test carried out in a direction perpendicular to the rolling direction were high, and the bending formability was favorable. In addition, edge crackings were not generated.

Based on what has been described above, it was confirmed that, according to the present embodiment, it is possible to provide a copper alloy for an electronic/electric device and a plastically-worked copper alloy material for an electronic/electric device which have an excellent bending formability in the direction of GW and a high strength in the direction of BW and are excellent in formability so that the copper alloy and the plastically-worked copper alloy material are formed into a small-sized terminal.

INDUSTRIAL APPLICABILITY

The copper alloy for an electronic/electric device of the present embodiment is excellent in strength and bending formability and, particularly, has an excellent bending formability in the direction of GW and a high strength in the direction of BW. Therefore, the copper alloy for an electronic/electric device of the present embodiment is applied to a component for an electronic/electric device such as a terminal including a connector in a semiconductor device or the like, a movable conductive piece for an electromagnetic relay, a lead frame, or the like.

The invention claimed is:

1. A copper alloy for an electronic/electric device comprising:

Mg at an amount of 3.3 atom % to 6.9 atom % with a remainder substantially being Cu and inevitable impurities, wherein a strength ratio $TS_{TD}/TS_{LD}$ is more than 1.02, and the strength ratio $TS_{TD}/TS_{LD}$ is calculated from a strength $TS_{TD}$ measured by a tensile test carried out in a direction perpendicular to a rolling direction and a strength $TS_{LD}$ measured by a tensile test carried out in a direction parallel to the rolling direction.

2. The copper alloy for an electronic/electric device according to claim 1, wherein, in a scanning electron microscopic observation, an average number of intermetallic compounds which have sizes of 0.1 μM or larger and include Cu and Mg as main components is 1 piece/$\mu m^2$ or less.

3. The copper alloy for an electronic/electric device according to claim 1, wherein, when an amount of Mg is given as X atom %, an electrical conductivity σ (% IACS) is in a range of the following expression, $$\sigma \leq 1.7241/(-0.0347 \times X^2 + 0.6569 \times X + 1.7) \times 100.$$

4. The copper alloy for an electronic/electric device according to claim 1, further comprising:

one or more selected from Sn, Zn, Al, Ni, Si, Mn, Li, Ti, Fe, Co, Cr, Zr, and P at a total amount of 0.01 atom % to 3.00 atom %.

5. The copper alloy for an electronic/electric device according to claim 1, wherein the strength $TS_{TD}$ is 400 MPa or more, and a bending formability R/t is 1 or less, and the bending formability R/t is a ratio of a radius of a W bending jig which is represented by R to a thickness of the copper alloy which is represented by t when a direction perpendicular to the rolling direction is set as a bending axis.

6. A plastically-worked copper alloy material for an electronic/electric device, which is formed by plastically working a copper material consisting of the copper alloy for an electronic/electric device according to claim 1.

7. The plastically-worked copper alloy material for an electronic/electric device according to claim 6, wherein the plastically-worked copper alloy material for an electronic/electric device is formed by a manufacturing method which includes:

a heating step of heating the copper material to a temperature of 400° C. to 900° C.;

a rapid cooling step of cooling the heated copper material to 200° C. or lower at a cooling rate of 60° C./min or higher; and a plastic working step of plastically working the copper material.

8. The plastically-worked copper alloy material for an electronic/electric device according to claim 6, wherein a surface is subjected to Sn plating.

9. A component for an electronic/electric device, consisting of the plastically-worked copper alloy material for an electronic/electric device according to claim 6.

10. A terminal consisting of the plastically-worked copper alloy material for an electronic/electric device according to claim 6.

* * * * *